United States Patent [19]

Brayley et al.

[11] 4,005,294

[45] Jan. 25, 1977

[54] IGNITION BREAKER POINT ARRANGEMENT

[75] Inventors: Elwin J. Brayley, East Longmeadow; Allen L. Brownlee, Westfield; John C. Garen, West Springfield, all of Mass.

[73] Assignee: Eltra Corporation, Toledo, Ohio

[22] Filed: May 2, 1975

[21] Appl. No.: 574,174

[52] U.S. Cl. ..... 200/19 A; 200/30 A

[51] Int. Cl.[2] ..... H01H 19/00

[58] Field of Search ..... 123/19 A, 30 A, 146.5 A; 200/19 R, 19 A, 30 R, 30 A, 30 AA, 31 R, 31 A, 31 DP, 31 V, 293

[56] References Cited

UNITED STATES PATENTS

| | | | |
|---|---|---|---|
| 2,730,583 | 1/1956 | Brunk | 123/146.5 A X |
| 2,851,546 | 9/1958 | Phelon et al. | 200/30 A |
| 2,979,577 | 4/1961 | Adler | 200/19 A X |
| 3,399,657 | 9/1968 | Amblard | 200/30 A X |
| 3,419,689 | 12/1968 | Steinke | 200/19 A |
| 3,510,608 | 5/1970 | Cooksey et al. | 200/19 A |
| 3,622,715 | 11/1971 | Jukes | 200/31 A X |
| 3,795,778 | 3/1974 | Rees | 200/30 A X |
| 3,862,384 | 1/1975 | Hrabousky | 200/31 DP X |
| 3,908,102 | 9/1975 | Seike | 200/30 A X |

*Primary Examiner*—James R. Scott
*Attorney, Agent, or Firm*—Robert H. Johnson

[57] ABSTRACT

A breaker point is supported on an abutment of a breaker plate having an integral post supporting a breaker lever urged toward the abutment by a spring fastened to another abutment. A bridging member connected to the abutments supports the free end of the post. An uncanned capacitor is sealed in a receptacle formed in the breaker plate which is constructed from an electrically insulating material. The capacitor is connected to the spring and the breaker point by conductor straps, plated sections or capacitor leads secured in recesses in the breaker plate with a portion exposed for grounding.

14 Claims, 16 Drawing Figures

IGNITION BREAKER POINT ARRANGEMENT

BACKGROUND OF THE INVENTION

This invention relates to an ignition system for a small internal combustion engine, and more particularly to a breaker point arrangement for a magneto ignition system.

In an ignition system for a small internal combustion engine, for example a one-cylinder engine used to drive a small chain saw, the ignition pulses may be produced in response to the opening and closing of a pair of breaker points in timed relation with operation of the engine. One of the breaker points is stationary while the other breaker point is carried by a breaker lever which is resiliently urged against the stationary breaker point, and the breaker points are opened and closed upon movement of the breaker lever in association with the operation of the engine. The breaker points are typically arranged on a breaker plate as a unit for ease of assembly with the engine, and a capacitor is electrically connected across the breaker points to reduce electrical arcing.

In the past, the breaker points have often been mounted on a metal breaker plate having a turned-up ear supporting the stationary breaker point while the breaker lever is pivotally supported on a metal post which is staked to the breaker plate. The capacitor is typically contained in a metal can having an insulated lead for electrical connection with the movable breaker point, while the metal can serves as the other capacitor lead and is soldered to the metal plate for electrical connection with the stationary breaker point. The breaker point arrangement on the metal breaker plate is mounted as a unit in a cylindical opening formed in the engine casing, and the breaker plate is electrically grounded to the engine by a screw which secures the breaker plate to the engine casing.

However, with the advent of smaller less expensive chain saws requiring shorter periods of operation, it is desirable to provide a less expensive ignition system by reducing the cost of the breaker point arrangement. A substantial cost reduction could be achieved by utilizing a less expensive capacitor which is not contained in the metal can. However, the substitution of a less expensive capacitor is precluded by the operating environment of the breaker point arrangement which is subject to substantial temperature variations and mechanical vibrations. Moreover, the leads of such an inexpensive capacitor are uninsulated and could undesirably contact another electrical conductor.

SUMMARY OF THE INVENTION

Accordingly, an object of the present invention is to provide an inexpensive breaker point arrangement for use with a small inexpensive chain saw.

Another object of the invention is to provide an inexpensive breaker point arrangement utilizing an uncanned capacitor.

Still other objects, features and advantages of the present invention will become apparent to those skilled in the art from a reading of the following detailed description of several preferred embodiments of the invention in conjunction with the accompanying drawing:

Figure 1:
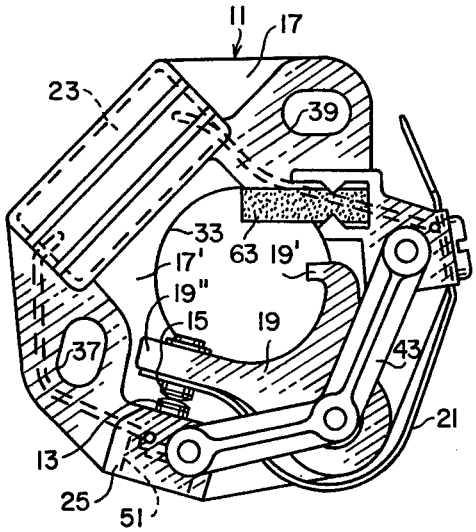
FIG. 1 is a top view of a breaker point arrangement constructed in accordance with the present invention.
Figure 4:
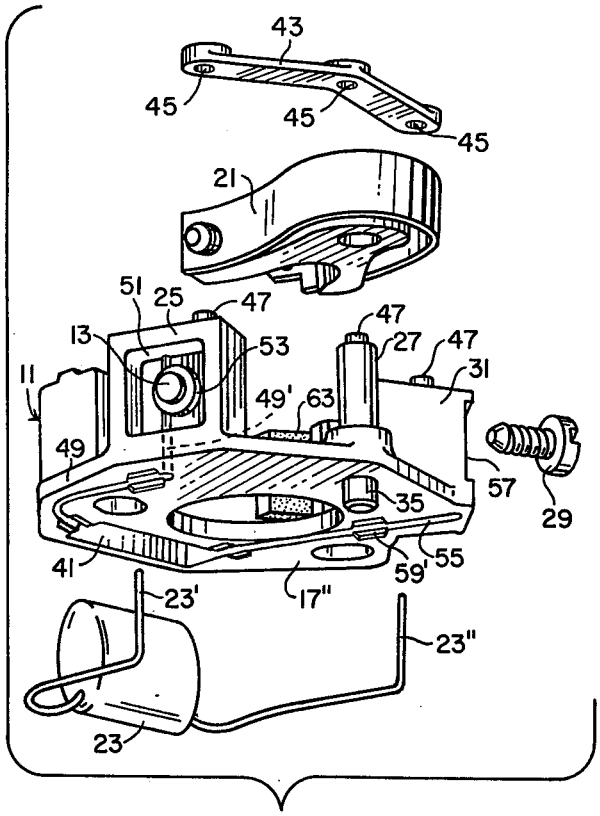
FIG. 4 is an exploded perspective view of the breaker point arrangement of FIG. 1.
Figure 2:
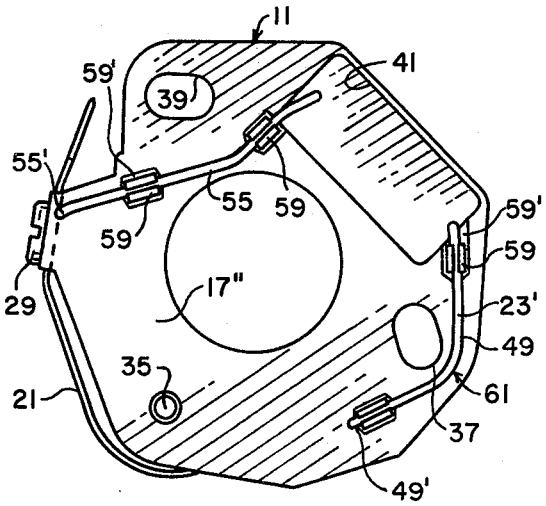
FIG. 2 is a bottom view of the breaker point arrangement shown in FIG. 1.

Referring now in detail to the figures in the drawing, and more particularly to FIGS. 1–4, there is shown a breaker point arrangement, generally indicated 11, for a magneto ignition system which is operated to supply ignition pulses to a small internal combustion engine, not shown. As is conventional, the magneto ignition system includes a pair of cooperating breaker points 13, 15 which are connected in circuit with a primary winding of an ignition coil for controlling the energization of the coil to effect ignition pulses in a secondary winding of the coil. An energizing current may be induced in the ignition coil by a permanent magnet rotating with a flywheel, not shown, which is mounted on an engine crankshaft, and the ignition pulses are produced in response to the opening and closing of the breaker points 13, 15. The breaker point 13 is stationary and supported on a breaker plate 17 while the other breaker point 15 is carried by a breaker lever 19 and urged against the stationary breaker point 13 by a spring 21. The breaker points 13, 15 are opened and closed by the pivoting of the breaker lever 19 in accordance with the movement of a cam, not shown, which may be mounted on the engine crankshaft, and a capacitor 23 is electrically connected across the breaker points 13, 15 for reducing the electrical arcing associated with their movement. The details of the magneto ignition system and the engine have not been shown since they form no part of the present invention and may be desirably conventional.

As shown, the breaker points 13, 15 are arranged on an upper side 17' of the breaker plate 17 which has an abutment 25 supporting the stationary breaker point 13 while the breaker lever 19 is supported on a pivot post 27. The breaker lever 19 is generally L-shaped with an arm 19′ serving as a cam follower for engaging the cam mounted on the crankshaft and with another arm 19″ carrying the breaker point 15. The spring 21 urging the breaker lever 19 toward the stationary breaker point 13 is in the form of a leaf spring which is clamped to the arm 19″ of the breaker lever 19 by the riveting of the breaker point 15 and secured by a suitable screw 29 to another abutment 31 of the breaker plate 17. The breaker plate 17 has a central opening 33 through which the end of the crankshaft is received as the breaker point arrangement 11 is placed in a cylindrical opening in the engine casing, and the breaker point arrangement 11 is located relative to the axis of the crankshaft by a pin 35 projecting downwardly from a bottom side 17″ of the breaker plate 17 for receipt in a positioning hole in the engine casing. The opening between the breaker points 13, 15 may be adjusted by pivoting the breaker plate 17 about the pin 35 which is axially aligned with the pivot pin 27, and the breaker point arrangement 11 may be secured to the engine casing by a pair of threaded screws, not shown, which are received through a pair of openings 37, 39 in the breaker plate 17.

Figure 3:
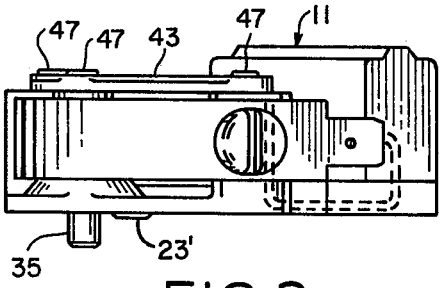
FIG. 3 is a side view of the breaker point arrangement of FIG. 1.
Figure 5:
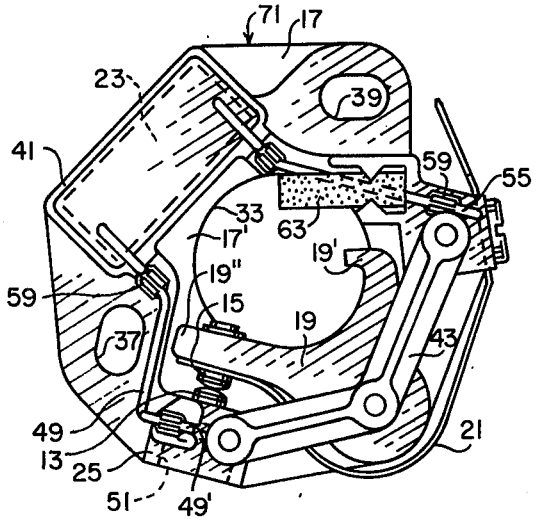
FIG. 5 is a top view of another embodiment of a breaker point arrangement constructed in accordance with the present invention.
Figure 8:
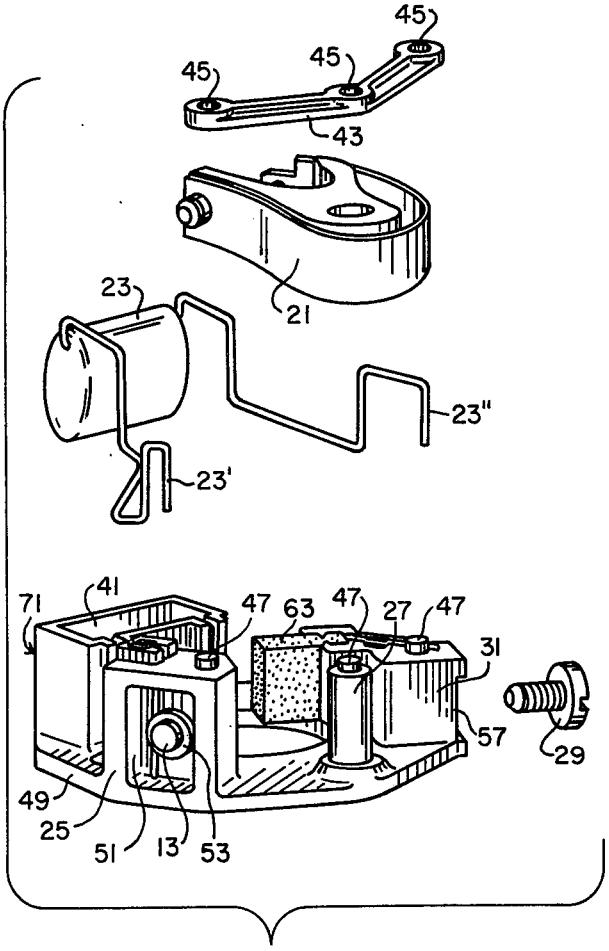
FIG. 8 is an exploded perspective view of the breaker point arrangement of FIG. 5.
Figure 6:
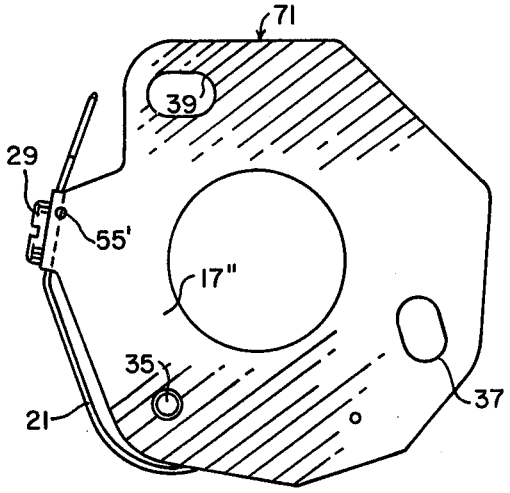
FIG. 6 is a bottom view of the breaker point arrangement of FIG. 5.
Figure 7:
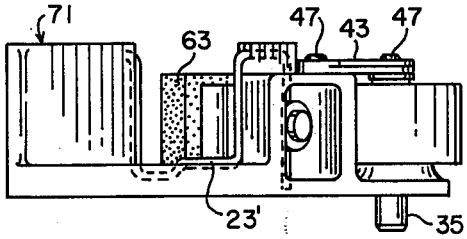
FIG. 7 is a side view of the breaker point arrangement of FIG. 5.

In accordance with the present invention, the cost of the magneto ignition system is reduced by utilizing an inexpensive, uncanned capacitor 23 and constructing the breaker plate 17 from an electrically and thermally insulating thermoplastic material such as polyester or nylon with about thirty percent glass filler. As shown, the breaker plate 17 has wall means defining a receptacle 41 which opens externally on the bottom surface 17″ of the breaker plate 17 for receiving the capacitor 23 as will be explained below in further detail, and the breaker plate 17 is formed integrally with the pivot post 27 on which the breaker lever 19 is pivotally supported. To prevent the pivot post 27 from being deflected undesirably during the pivotal movement of the breaker lever 19, the free end of the pivot post 27 is provided with additional support by a bridge member 43 which is secured to the abutments 25 and 31. As more particularly shown in FIG. 4, the bridge member 43 has three spaced-apart openings 45 for receiving corresponding projections 47 formed on the pivot post 27 and the abutments 25, 31, and the bridge member 43 may be riveted to the breaker plate 17 by heat deforming the ends of the projections 47 as shown in FIG. 3.

Although different types of capacitors 23 may be used with the breaker plate 17, such as a monolithic chip capacitor, in a preferred embodiment the capacitor 23 may be of a commercially available type constructed from a suitable polyester film and having a pair of uninsulated leads 23′, 23″ connected to the capacitor plates. To secure the capacitor leads 23′, 23″ from mechanical vibration as well as electrically insulate them, the leads 23′, 23″ are received in recesses formed in the bottom side 17″ of the breaker plate 17 while the capacitor 23 is received in the receptacle 41. As more particularly shown in FIGS. 2 and 4, the capacitor lead 23′ is received in a slot 49 leading from the receptacle 41 to a hole 49′ extending upwardly to an opening 51 in the abutment 25 and the end of the capacitor lead 23′ is connected to the breaker point 13 by a washer 53 carried on a cylindrical portion of the breaker point 13 which is riveted to the abutment 25. Similarly, the capacitor lead 23″ is received in a slot 55 leading from the receptacle 41 to a hole 55′ extending upwardly to an open surface 57 of the abutment 31, and the end of the capacitor lead 23″ is clamped between the abutment 31 and the spring 21 by the screw 29. The intermediate portions of the capacitor leads 23′, 23″ are secured in the slots 49, 55 respectively, by projections 59 which are heat formed from recessed portions 59′ in the bottom side 17″ of the breaker plate 17 so as to extend into the slots 49, 55 while the capacitor 23 is secured inside the receptacle 41 by a suitable epoxy resin which also provides thermal insulation from the heat of the engine.

The breaker point 15 is electrically connected to the capacitor lead 23″ through the spring 21 which may be constructed from stainless steel, while the other breaker point 13 is electrically grounded to the engine casing by the capacitor lead 23′. As more particularly shown in FIGS. 2 and 3, the slot 49 is formed with a shallow portion, generally indicated at 61, adjacent the opening 37 to cause a portion of the lead 23′ to extend slightly beyond the bottom surface 17″ of the breaker plate. Accordingly, when the breaker plate 17 is secured to the engine casing by a threaded screw which is received through the opening 37 as previously described, the capacitor lead 23′ will be clamped against the engine casing.

Another embodiment of a breaker point arrangement constructed in accordance with the present invention is shown in FIG. 5–8. With the exception of the mounting of the capacitor 23 and the associated leads 23′, 23″, the breaker point arrangement 71 is identical to the breaker point arrangement 11 described previously, and accordingly identical reference numerals have been placed on identical portions thereof. In this embodiment, the breaker plate 17 has wall means defining a receptacle 41 opening externally on the upper side 17′ of the breaker plate 17 which has recesses for receiving the capacitor leads 23′, 23″. As shown, the lead 23′ is received in a slot 49 leading down the exterior of the receptacle 41 along the upper surface 17′ and upwardly along the abutment 25 to a hole 49′ extending downwardly to the opening 51 in the abutment 25 where the end of the lead 23′ is connected to the breaker point 13 as described in the preceding embodiment. The other capacitor lead 23″ is similarly received in another slot leading down the exterior side of the receptacle 41 along the upper surface 17′ beneath a felt brush 63 for greasing the surface of the cam and upwardly along the abutment 31 to a hole 55′ extending downwardly to the surface 57 where the end of the lead 23″ is clamped against the spring 21 as also previously described. The intermediate portions of the leads 23′, 23″ are secured in the slots 49, 55 respectively, by projections 59 which are best formed from portions adjacent the slots 49, 55, while the capacitor 23 is potted inside the receptacle 41 by a suitable epoxy resin. With the lead 23′ located on the upper surface 17′, the breaker point 13 is grounded to the engine casing by a screw which is received through the opening 37 and contacts an exposed portion of the lead 23′ as more clearly shown in FIG. 7.

Figure 9:
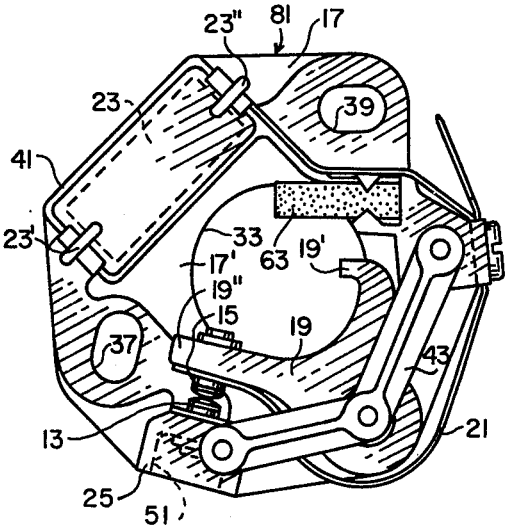
FIG. 9 is a top view of still another embodiment of breaker point arrangement constructed in accordance with the present invention.
Figure 12:
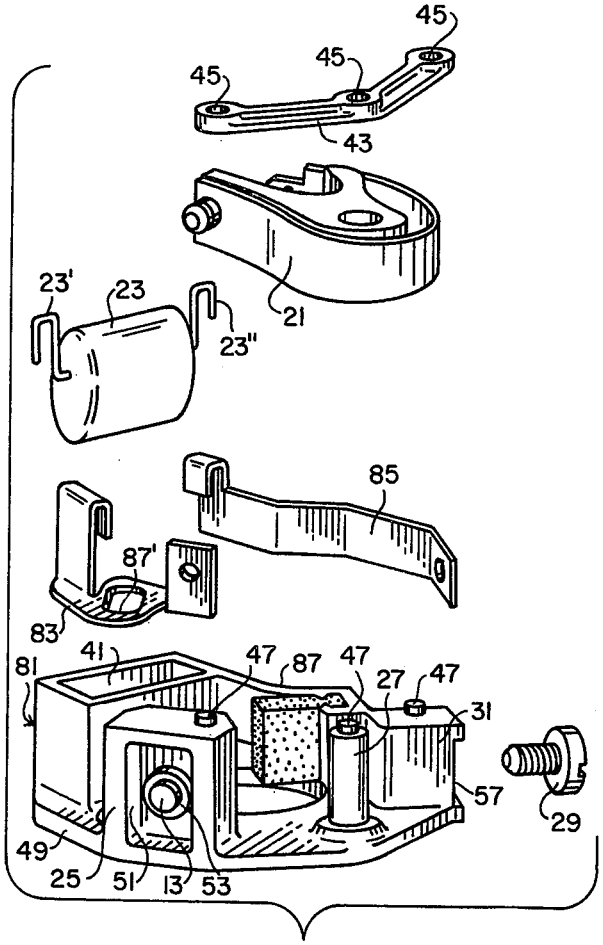
FIG. 12 is an exploded perspective view of the breaker point arrangement of FIG. 9.
Figure 10:
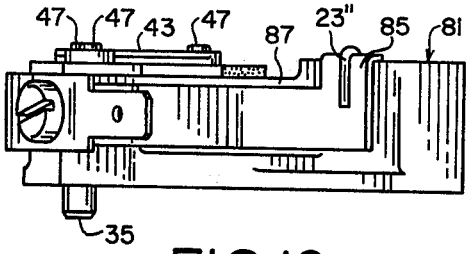
FIG. 10 is a side view of the breaker point arrangement shown in FIG. 9.
Figure 11:
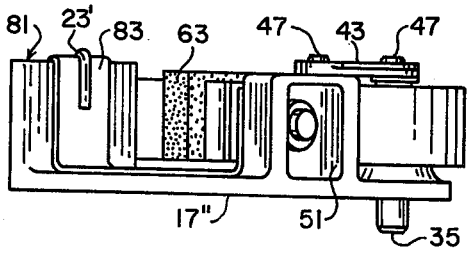
FIG. 11 is another side view of the breaker point arrangement of FIG. 9.
Figure 13:
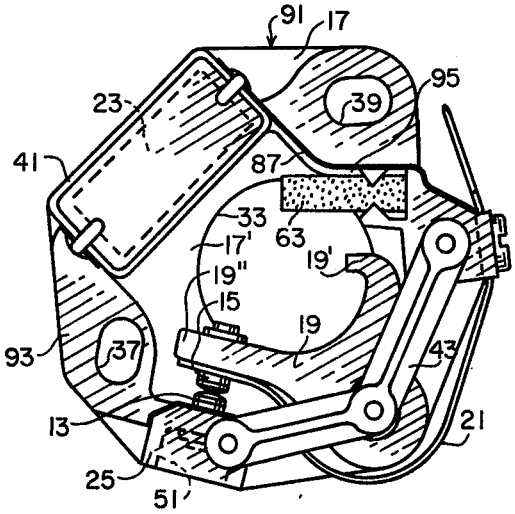
FIG. 13 is a top view of an additional embodiment of a breaker point arrangement constructed in accordance with the present invention.
Figure 16:
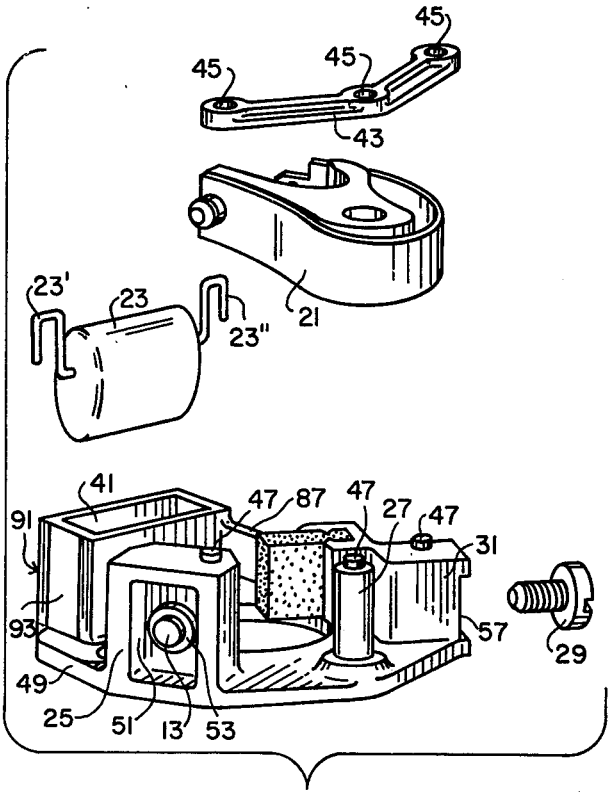
FIG. 16 is an exploded perspective view of the breaker point arrangement of FIG. 13.
Figure 14:
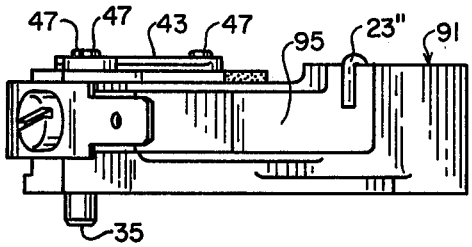
FIG. 14 is a side view of the breaker point arrangement of FIG. 13.
Figure 15:
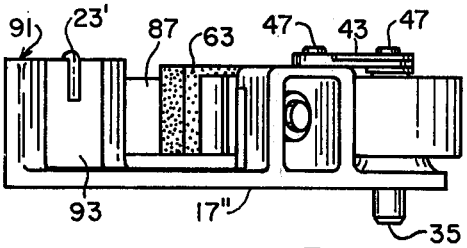
FIG. 15 is another side view of the breaker point arrangement shown in FIG. 13.

Still another embodiment of a breaker point arrangement constructed in accordance with the present invention is shown in FIGS. 9–11. With the exception of the electrical conductors used to connect the capacitor 23 to the breaker points 13, 15 the breaker point arrangement 81 of this embodiment is generally identical to that of FIGS. 5–8, and accordingly identical reference numerals have been placed on identical portions thereof. In this embodiment, the electrical conductors connecting the capacitor 23 to the beaker points 13, 15 include conductor straps 83, 85 respectively, which are constructed from a suitable material such as copper or beryllium copper. As shown, the conductor strap 83 has a bent portion hooked in the opening of the receptacle 41 and it extends downwardly along the exterior side of the receptacle 41 and upwardly along the abutment 25 to which it is clamped by the riveting of the breaker point 13. The other conductor strap 85 also has a bent portion hooked in the opening of the receptacle 41 and it extends along a wall 87 leading from the receptacle 41 to the abutment 31 where it is clamped against the spring 21 by the screw 29 as described in the previous embodiment. The capacitor leads 23', 23'' are soldered to the bent portions of the conductor straps 83, 85 respectively, and the capacitor 23 is potted in the receptacle 41 by a suitable epoxy resin. The conductor strap 83 has an opening 87' corresponding with the opening 37 in the breaker plate 17, and the breaker point 13 may be grounded to the engine casing by a suitable screw which is received through the openings 37, 87' for securing the breaker plate 17 to the engine casing.

A further embodiment of the invention is shown in FIGS. 13–16 which is similar to the embodiment shown in FIGS. 9–12, and accordingly identical reference numerals have been placed on identical portions thereof. In this embodiment, the electrical conductors for connecting the capacitor 23 to the breaker points 13, 15 are in the form of a copper plated sections 93, 95 on the breaker plate 17. As shown, the copper-plated section 93 extends from the exterior side of the receptacle 41 and along the upper surface 17' adjacent the opening 37 to the portion of the abutment 25 where the breaker point 13 is riveted. The other copper-plated section 95 extends from the opening of the receptacle 41 along the wall 87 formed on the breaker plate 17 to the surface portion 57 of the abutment 31 where the spring 21 is clamped by the screw 29. The capacitor leads 23', 23'' are soldered to the copper plated section 93, 95 respectively, and the capacitor 23 is potted in the receptacle 41 by a suitable epoxy resin. Alternatively, the capacitor leads 23', 23'' may be received through suitable openings, not shown, formed in the receptacle 41 and then soldered to the copper-plated section 93, 95 respectively. Finally, the breaker point 13 may be electrically grounded to the engine casing by a screw received through the opening 37 in contact with the copper-plated section 93.

What is claimed is:

1. In a contact breaker assembly including a breaker plate supporting a stationary breaker point thereon and a breaker lever carrying another breaker point and being pivotally supported on the breaker plate for movement into engagement with the stationary breaker point, a capacitor having a pair of electrically conductive plates and means for electrically connecting one of the capacitor plates to the stationary breaker point and electrically connecting the other capacitor plate to the breaker point carried by the breaker lever, the improvement comprising:

said breaker plate being constructed integrally from an electrically insulating material and having wall means defining a receptacle, and said capacitor being disposed in the receptacle of said breaker plate.

2. In a contact breaker assembly according to claim 1:

said capacitor having a pair of strip wire leads each connected to a different one of the pair of capacitor plates, and said electrical conductor means including said pair of strip wire leads.

3. In a contact breaker assembly according to claim 1, said breaker plate having recesses formed therein for receiving a portion of said electrical conductor means.

4. In a contact breaker assembly according to claim 3, said breaker plate having projections extending into said recesses for securing said electrical conductor means in said recesses.

5. In a contact breaker assembly according to claim 3:

said capacitor having a pair of strip wire leads each connected to a different one of the pair of capacitor plates, and said electrical conductor means including said pair of strip wire leads with a portion of the strip wire leads being received in the recesses formed in said breaker plate.

6. In a contact breaker assembly according to claim 5:

said breaker plate having projections extending into said recesses, and said projections being heat-formed from portions of the breaker plate adjacent the recesses.

7. In a contact breaker assembly according to claim 1:

said breaker plate having a surface on which the breaker points are arranged and another surface for engagement with an electrically conductive member, said breaker plate having recesses formed in the other surface and said receptacle opening externally to the other surface, said capacitor having a pair of strip wire leads each connected to a different one of a pair of capacitor plates, and said electrical conductor means including said pair of strip wire leads with a portion of the strip wire leads being received in the recesses in said breaker plate.

8. In a contact breaker assembly according to claim 7, said breaker plate having projections extending into said recesses for securing the strip wire leads in said recesses.

9. In a contact breaker assembly according to claim 7, said recesses formed in the other surface of said breaker plate having a shallow portion for exposing a portion of one of the strip wire leads for electrical contact with the electrically conductive member.

10. In a contact breaker assembly according to claim 1:

said breaker plate having a surface for engagement with a member and another surface on which the breaker points are arranged, said wall means defining a receptacle opening externally to the other surface of said beaker plate, and said electrical conductor means including electrically conductive plating on the other surface of said breaker plate.

11. In a contact breaker assembly according to claim 1:

said breaker plate having a surface for engagement with a member and another surface on which the breaker points are disposed, said wall means defining a receptacle opening externally to the other surface of said breaker plate, and said electrical conductor means including electrically conductive straps secured to the other surface of said beaker plate.

12. In a contact breaker assembly according to claim 1:

said breaker plate having a surface for engagement with a member and another surface on which the breaker points are disposed, said breaker plate having recesses formed in the other surface and said wall means defining a receptacle opening externally to the other surface, said capacitor having a pair of strip wire leads each connected to a different one of the pair of capacitor plates, and said electrical conductor leads including said pair of strip wire leads with a portion of the strip wire leads being received in the recesses of said breaker plate.

13. In a contact breaker assembly according to claim 12, said breaker plate having projections extending into said recesses for securing the strip wire leads in said recesses.

14. In a contact breaker assembly according to claim 1:

said breaker plate having an abutment formed on the other surface for supporting the stationary breaker point, said breaker lever being pivotally supported on a pivot pin formed integrally with said breaker plate, said breaker plate having another abutment formed on the other surface, spring means secured to said other abutment and said breaker lever for resiliently urging said breaker lever into contact with the stationary breaker point, and a bridging member secured to said pivot pin and to each of said abutments for supporting said pivot point.

* * * * *

UNITED STATES PATENT AND TRADEMARK OFFICE

CERTIFICATE OF CORRECTION

PATENT NO. : 4,005,294

DATED : January 25, 1977

INVENTOR(S) : ELWIN J. BRAYLEY ET AL

It is certified that error appears in the above-identified patent and that said Letters Patent are hereby corrected as shown below:

Column 5, line 3, for "beaker" read --breaker--. Column 6, line 60, for "beaker" read --breaker--. Column 7, line 5, for "beaker" read --breaker--.

Signed and Sealed this

Fifth Day of April 1977

[SEAL]

*Attest:*

RUTH C. MASON
*Attesting Officer*

C. MARSHALL DANN
*Commissioner of Patents and Trademarks*